United States Patent [19]

Hutley

[11] 4,138,942

[45] Feb. 13, 1979

[54] PRINTING DEVICE FOR PRINTING ON A CONTINUOUSLY MOVING FORM

[75] Inventor: Ronald Hutley, Lansdale, Pa.

[73] Assignee: Sperry Rand Corporation, New York, N.Y.

[21] Appl. No.: 821,252

[22] Filed: Aug. 2, 1977

[51] Int. Cl.[2] ..... B41J 9/12

[52] U.S. Cl. ..... 101/93.08; 400/152; 400/157; 101/93.23

[58] Field of Search ..... 101/93.08, 93.11, 93.19, 101/93.23; 197/48, 49, 53, 19, 11, 157, 152

[56] References Cited

U.S. PATENT DOCUMENTS

| | | | |
|---|---|---|---|
| Re. 26,240 | 7/1967 | Wasserman | 101/93 |
| 2,843,243 | 7/1958 | Masterson | 197/19 |
| 2,850,967 | 9/1958 | Wooding | 101/93 |
| 2,850,968 | 9/1958 | Pape | 101/93 |
| 3,058,415 | 10/1962 | Hoffmann | 101/93 |
| 3,168,182 | 2/1965 | Bernard et al. | 197/55 |
| 3,599,772 | 8/1971 | Comstock | 197/49 |
| 3,724,631 | 4/1973 | Kaczeus | 197/49 |
| 3,896,919 | 7/1975 | Hutley | 197/49 |
| 3,913,722 | 10/1975 | Bowdle et al. | 101/93.23 |
| 3,918,568 | 11/1975 | Shimodira | 197/49 |

*Primary Examiner*—Edward M. Coven

*Attorney, Agent, or Firm*—Thomas J. Scott; William E. Cleaver; Marshall M. Truex

[57] ABSTRACT

The present device is a means for printing multi-lines of characters simultaneously on a continuously moving print receiving medium or form and in a manner eliminating the need for indexing the form line by line and column by column. Multiple type fonts are arranged in helical paths around a continuously rotating drum, the axis of which is positioned at an angle to the path of movement of the form whereby each font is effective to print an individual line of character on the form as it progresses along its path of movement.

7 Claims, 3 Drawing Figures

PRINTING DEVICE FOR PRINTING ON A CONTINUOUSLY MOVING FORM

BACKGROUND

Single line printers of the drum and hammer type are well known. In these printers, characters are arranged around the periphery of the drum, or type wheel, which is rotated in a manner to pass the characters individually past a print station wherein a print hammer is actuated selectively to print individual characters on a print receiving form which is indexed step by step through the print station column by column, along with a ribbon, to print selected characters on a single line on the form while the form is stationary. To print additional lines of characters, the form must by necessity be indexed in a manner to present each additional line thereof for printing, while the form is stationary, and the form indexed again, column by column, through the print station for each line to be printed.

The disadvantage of the above described printers is in the time consumed for indexing the form column by column during the printing of a line of characters and line by line to print additional lines.

SUMMARY

The present printing device provides a means for printing multi-lines of character on a continuously moving print receiving medium or form simultaneously in a manner eliminating the need for indexing the form column by column and line by line. Briefly it comprises a type drum having around its periphery a plurality of character fonts arranged in individual and separate helical paths. The drum axis is positioned at an angle somewhat less than 90° or off the normal to the path of movement of the form upon which the characters are to be printed. Means are provided to move the form continously past the drum wherein hammers are positioned, one for each character font, and selectively actuated to print multi-lines of characters, one line for each character font, simultaneously as the drum is rotated about its axis. The pitch of the helically arranged character fonts and the speed of the moving form is such that each character of each font passes sequentially through each column printing position on the form.

Elimination of the indexing devices makes the present multi-line printer mechanically and electrically simpler, thus less expensive, and more reliable than those of the prior art.

DESCRIPTION OF THE PREFERRED EMBODIMENT

Figure 1:
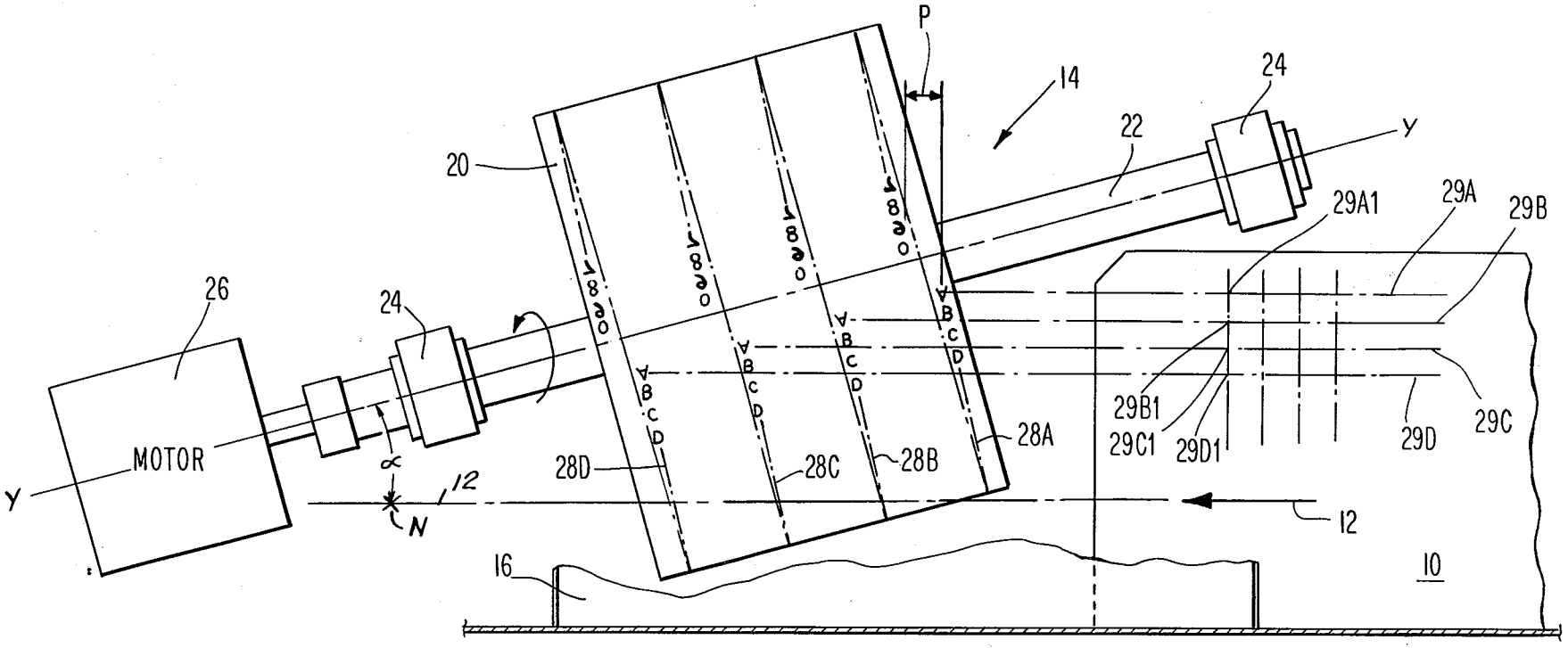
FIG. 1 is a fragmentary elevational view showing the angular position of the drum relative to the path of movement of the form on which the multi-lines of characters are to be printed.
Figure 2:
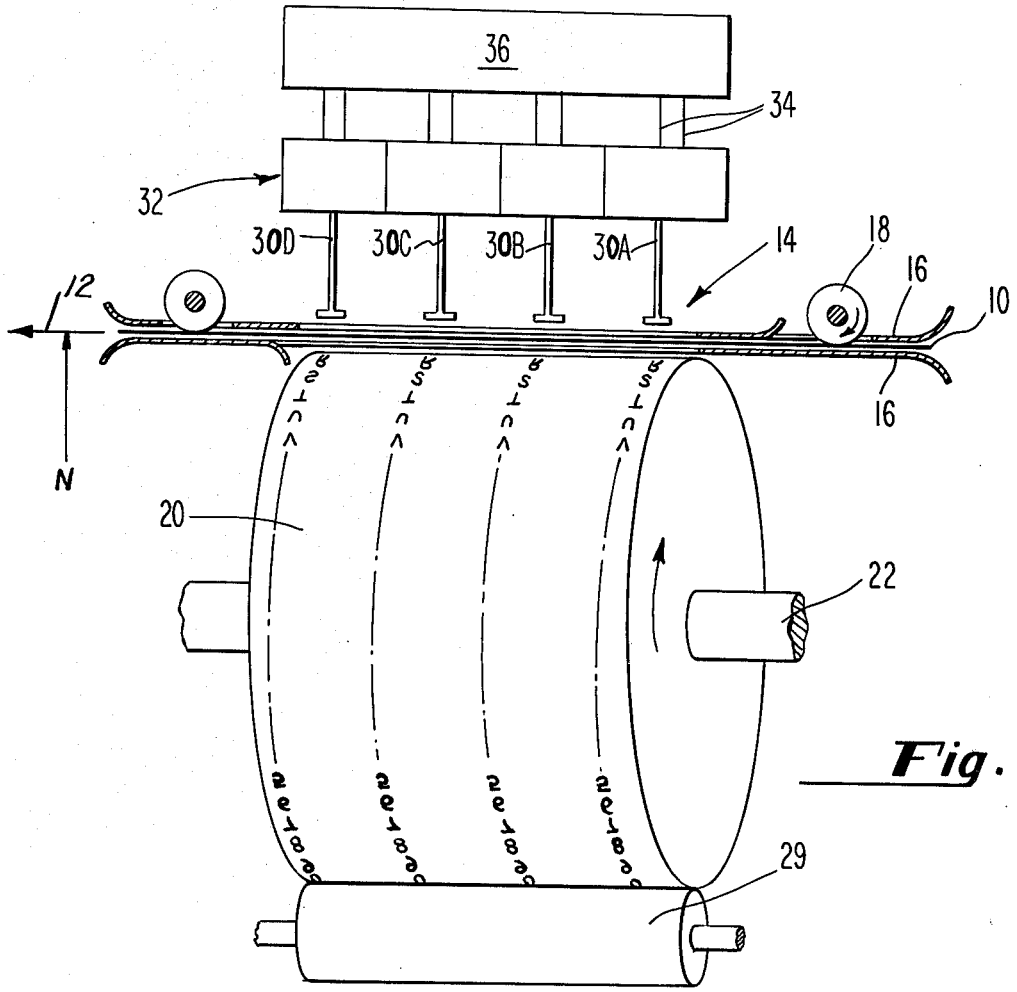
FIG. 2 is a fragmentary top plan view showing the overall arrangement of the printing device.

In the drawings it is seen that a form or recording medium 10 is traveling to the left as shown by arrow 12 to pass through the print station 14 as guided by channel members 16. The form is driven at a constant speed by conventional means herein shown as rollers 18 at opposite sides of the print stations, and driven by a motor, not shown in the drawings.

A print or type drum 20 is positioned at printing station 14 on a drive shaft 22 mounted in bearing blocks 24 for rotation at a constant speed by motor 26. Drum 20 is provided with a plurality — four in this embodiment — of individual bands of character fonts 28 A, B, C, and D, preferably in the form of raised type. Each font is arranged around the drum in a helical path, the pitch of which is indicated by the letter "P".

Form 10 may be pressure sensitive or it may carry its own carbon, not shown. Alternatively, an inking roller 29 may be provided to ink the font characters as the drum rotates.

Figure 3:
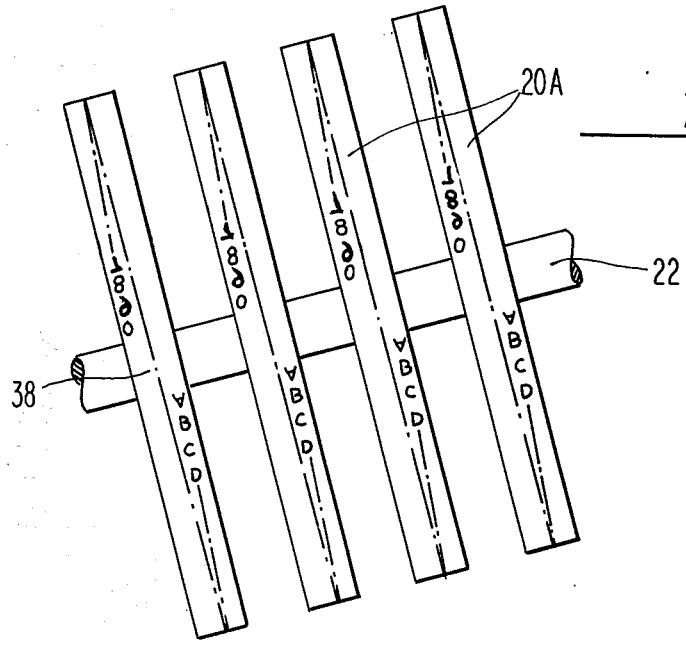
FIG. 3 illustrates a modification of the font carrying drum.

While a drum has been illustrated in this preferred embodiment, it will be understood that each font may be carried upon an individual wheel 20A fixed to drive shaft 22, as shown in FIG. 3.

In particular accordance with this invention, the axis Y—Y of drum 20 and shaft 22 is positioned at an angle $\alpha$ off the normal N to the path of movement of form 10 whereby the type character of each font 28 closest to the form is positioned to effect printing of a different line of characters indicated by the broken lines 29 A, B, C, and D on the form. The distance between the lines is determined by the angularity of the drum relative to the path of movement of the form.

Because of the angular position of the drum, the characters 28 preferably are formed angularly with respect to the helical path of its font so that they print on the form in a substantially upright condition.

Print hammers 30 A, B, C, and D are positioned opposite on a line and, co-axially with the drum 20, one in line with each corresponding print line 29 A, B, C, and D. The hammers are fired in a conventional fashion illustrated diagrammatically herein as by solenoids 32 connected by wires 34 to a suitable control means 36. The heads of the hammers are of sufficient width to span each character of its associated font as it passes through its printing position.

Pitch "P" of fonts 28, is substantially equal to the distance between columnar printing positions on form 10 indicated by the broken vertical lines thereon. As the form is moved through the print station 14 at a constant velocity, the constant rotational velocity of drum 20 is such that each character of each font 28 will pass sequentially through each column printing position on the form. As a result, the drum 20 makes one revolution for each movement of the form 10 through one column space past the print station 14. The fonts do not extend completely around the drums, as seen in FIG. 3, thus to leave a gap 38 sufficient for the hammers to reset if the last and first characters are to be printed sequentially.

The first column print position of line 29A is at 29A1. When the required character in font 28A reaches this position as the form moves through the print station, it is printed by hammer 30A. As the form progresses, selected characters of font 28A can be printed column by column across line 29A as required. When the form progresses to a point wherein the first character of font 28B is in line with the first column position 29B1 of line 29B, printing can start for this line. Similarly printing may start on line 29C and 29D as their first printing column 29C1 and 29D1 is reached by their respective fonts 28C and 28D.

The control means 36 is conventional, but may be such as that shown and described in U.S. Pat. No. 2,843,243 or that in U.S. Pat. No. 3,220,343.

The number of lines to be printed is limited only by the number of fonts provided.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. A multi-line printer for simultaneously printing a plurality of lines of type on a moving print receiving medium comprising, a continuously rotatable print drum having a plurality of peripherally arranged helical bands of type fonts, one font band for each print line on the print receiving medium, means for moving a print receiving medium continuously past said drum which has its axis of rotation positioned in a plane parallel to the plane of said print receiving medium and at an acute angle off the normal to the path of movement of said print receiving medium and a plurality of print hammers, one for each band of type font on the drum.

2. A printer according to claim 1 wherein said print drum comprises a plurality of wheels fixed to a drive shaft, each wheel being provided with at least one of said helical bands of type fonts.

3. A printer according to claim 1 wherein means are provided to move said print receiving medium at a velocity which permits the said drum to make at least one complete revolution for each movement of said print receiving medium through one column space.

4. A printer according to claim 1 wherein the pitch of said helical bands of type fonts is substantially equal to the column spacing on said print receiving medium.

5. A printer according to claim 1 wherein said print hammers are mutually displaced from one another on a line coaxial with the axis of said drum and one in line with each corresponding print line.

6. A multi-line printer for simultaneously printing a plurality of lines of characters on a moving print receiving form comprising, a continuously rotatable print drum having a plurality of separate helically arranged bands of character fonts around its periphery, one band for each line of print on said form, the pitch of each helical band being substantially equal to the column spacing on said form, means for moving said form past said drum which has its axis of rotation positioned in a plane parallel to the plane of said print receiving form and at an angle somewhat less than 90° to the path of movement of said print receiving form and at a velocity permitting said drum to make one revolution for each movement of said form through one column space, and a plurality of print hammers, one for each line of print, said hammers being arranged on a line co-axially with said drum and mutually displaced from one another a distance placing each in line with an individual line of print.

7. A printer according to claim 6 wherein said drum comprises a plurality of wheels fixed to a drive shaft, each wheel having at least one of said character fonts helically arranged around its periphery.

* * * * *